United States Patent [19]

Triebel et al.

[11] Patent Number: 4,463,281

[45] Date of Patent: Jul. 31, 1984

[54] HIGH-PRESSURE ELECTRIC DISCHARGE LAMP WITH ELECTRODE SUPPORT

[75] Inventors: Walter Triebel; Heinz Bunke, both of Eichstätt, Fed. Rep. of Germany

[73] Assignee: Patent-Treuhand-Gesellschaft für elektrische Glühlampen mbH, Munich, Fed. Rep. of Germany

[21] Appl. No.: 288,408

[22] Filed: Jul. 30, 1981

[30] Foreign Application Priority Data

Aug. 6, 1980 [DE] Fed. Rep. of Germany ..... 3029824

[51] Int. Cl.[3] ..... H01J 61/073; H01J 61/30; H01J 61/36; H01J 9/18

[52] U.S. Cl. ..... 313/623; 313/335; 445/26; 445/29

[58] Field of Search ..... 313/623, 624, 625, 335; 445/29, 26

[56] References Cited

U.S. PATENT DOCUMENTS 1,820,392 8/1931 Hotchner ..... 445/26 X
3,140,417 7/1964 Tietze .
4,038,578 7/1977 Mathijssen .

FOREIGN PATENT DOCUMENTS 1132242 1/1963 Fed. Rep. of Germany .
2623099 12/1976 Fed. Rep. of Germany .

*Primary Examiner*—Palmer C. Demeo
*Attorney, Agent, or Firm*—Frishauf, Holtz, Goodman & Woodward

[57] ABSTRACT

A high-pressure electric discharge lamp comprises a support part surrounding each electrode rod, each electrode rod having a spring wound therearound and pressing the respective support part toward an electrode mounted at the end of the respective electrode rods. This arrangement comprises a part of an assembly which is then mounted into envelope necks which extend from respective opposite ends of a quartz glass envelope which defines the discharge space of the lamp. A narrowing area is defined at the transition of the envelope necks to the envelope, the supporting parts each having a rounded end resting against a respective inclined surface defined by the narrowings at the transitions between the envelope necks and the envelope. The springs resiliently bias the supporting parts against the inclined inner surfaces of the narrowings. Also disclosed is a method of manufacture of the above described high-pressure electric discharge lamp.

12 Claims, 3 Drawing Figures

HIGH-PRESSURE ELECTRIC DISCHARGE LAMP WITH ELECTRODE SUPPORT

BACKGROUND OF THE INVENTION

This invention relates to a high pressure electric discharge lamp, and more particularly to such a lamp provided with means for securing the supporting part of the electrode rods thereof in the direction of the longitudinal axis of the lamp.

Parts supporting the electrode rod of a high-pressure electric discharge lamp have proved necessary since the seal extending only over a relatively short piece of the rod-shaped electrode lead-in wire is often exposed to a heavy strain caused by the weight and the length of the electrode rod. This may cause cracks in the sealing material so that the seal becomes leaky at the electrode lead-in wire.

It is known to use a supporting part which is provided in the envelope neck between the electrode and the electrode seal or the vacuum-tight passage of the lead-in wire, respectively, for instance, a cylindrical ring having a coefficient of expansion similar to that of the envelope material (shown in DE-PS No. 1 132 242). The surface area of the ring is sealed to the envelope neck by the cylindrical ring. From DE-OS No. 26 23 099 there is known a supporting part which is not sealed to the envelope neck. Various possibilities of securing the supporting part are indicated which require a precise adjustment and with which the finished lamp is disadvantageously treated at certain regions with temperatures up to the softening point of the envelope material.

In contrast, it is the object of the present invention to provide a lamp having parts which support the rod-shaped electrode, and whose manufacture is simpler and safer.

SUMMARY OF THE INVENTION

According to the present invention, an elongated high-pressure electric discharge lamp has a pair of electrode rods having respective electrodes at the ends thereof; a quartz glass envelope containing a rare gas and surrounding the discharge space and the electrodes; and a pair of envelope necks respectively coupled to opposite ends of the envelope and located in the direction of the longitudinal axis of the lamp, the envelope necks surrounding respective electrode rods and having at their outer ends a vacuum-tight seal to the respective electrode rod. The improvement according to the invention comprises the combination of a pair of supporting parts, each being mounted in a respective envelope neck, each supporting part having a smaller cross section than the envelope neck and being arranged between the respective electrode and electrode seal, the supporting parts each having a substantially central bore through which an electrode rod is passed so as to surround a respective electrode rod; each envelope neck having a narrowing at the transition thereof to the envelope, each narrowing having an inclined inner surface at the side thereof facing away from the discharge space in the envelope; each supporting part having a rounded end resting against a respective inclined surface, the rounded ends of the supporting parts facing the discharge space; and means for securing each supporting part in the direction of the longitudinal axis of the lamp with the supporting parts located between the discharge space and a respective electrode seal and bearing against a respective inclined surface of a respective narrowing; the envelope neck at its outer end forming the jacket tube for the electrode seal.

The invention also comprises a method of manufacturing such a lamp wherein a complete electrode assembly is mounted from each end.

DETAILED DESCRIPTION

Figure 1:
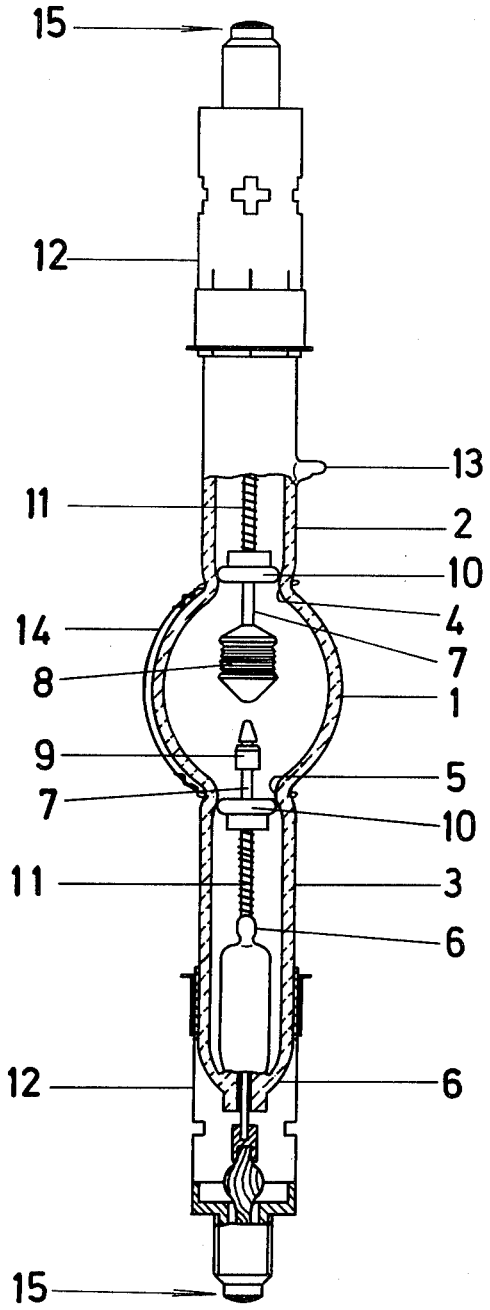
FIG. 1 illustrates, partially in section an embodiment of a lamp having the support structure of the present invention.

Referrring to FIG. 1, the lamp of the present invention comprises a quartz glass envelope 1 which at its opposite ends passes over into the envelope necks 2 and 3 with a narrowing portion 4,5 at each transition from the envelope 1 to an envelope neck 2,3. At the outer end of each envelope neck 2,3 is provided the seal 6 of the lamp stem. The completely mounted lamp stem comprises the seal 6, the electrode rod 7, the electrode 8,9, the supporting part 10 of quartz glass loosely arranged on the electrode rod 7 and the spring wire coil 11. At each end, a base shell 12 is pushed on over the sealed end of each envelope neck 2,3 and the electrode rod 7 is provided with an outer lead-in wire leading to a conducting end connector 15. The exhaust tip 13 of the lamp is located at the envelope neck 2. A starting wire 14 is laid from one electrode neck to the other one. The lamp is filled with xenon of 10 bar and has a wattage of 1 kW. As seen from FIG. 1, the lamp is substantially identically constructed at each end thereof. The envelope 1 defines the discharge space of the lamp.

The high-pressure electrode discharge lamp described above is characterized in that each envelope neck 2,3 has a narrowing portion 4,5 at the transition thereof to the envelope 1. The narrowing portions 4,5 each have an inclined inner surface at the side turned away from the discharge space, the supporting parts 10 resting against this inclined surface with a rounded end facing the discharge space in the envelope 1. The springs 11 are arranged for securing the supporting parts 10 between the discharge space 1 and the respective electrode seal, and the envelope necks 2,3 at their outer ends form the jacket tube for the electrode seal.

Figure 3:
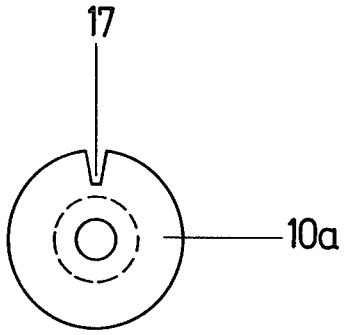
FIG. 3 illustrates a further modified supporting part of the present invention.
Figure 2:
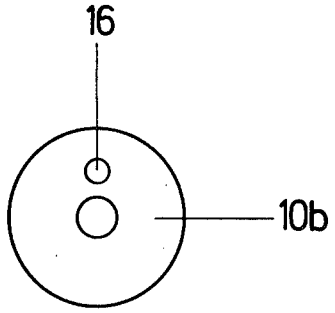
FIG. 2 illustrates a modified supporting part of the present invention.

The supporting parts 10 may each be a cylindrical ring, as shown. It is, however, preferable to use an embodiment with which only the end of the supporting part 10 facing the discharge space has a diameter similar to that of the envelope neck, whereas the remaining part has a smaller diameter. The ends of the supporting parts facing the discharge space are preferably rounded in order to avoid possible surface damage when pressing the supporting parts against the narrowing portions 4,5. It is important that the supporting parts 10 are not sealed to the envelope necks 2,3. In addition to the center bore, each supporting part 10 may have further perforations 16 (FIG. 2) and/or indentations 17 at the outer periphery of the part with the larger diameter (FIG. 3), whereby the cross section of the exhaust path is increased. As material for the supporting part 10, preferably quartz glass is used, but one may also use fused silica or ceramics. In contrast to the known constructions, according to the present invention the supporting parts 10 need not be fixedly positioned. They can be loosely arranged on the mounted stem and mounted shiftable in longitudinal direction on the electrode rod 7. The positioning of each supporting part 10 is automatically effected by the spring 11 pressing it to the narrowing portion 4,5 of the envelope neck.

The narrowing portions 4,5 may be formed by an inwardly directed groove or by inwardly directed indentations in the envelope neck at the transition to the envelope. Preferably a groove is applied having an inclined surface at the inner surface of the respective envelope neck on the side turned away from the discharge space, against which the respective supporting part 10 rests in a manner similar to a valve seat, thereby effecting a perfect and effective support of the electrode.

The springs 11 are a metal spring, a wire coil or a spring wire or the like, e.g., made of tungsten, located between the supporting part 10 and the seal 6, and serve to resiliently press the respective supporting part 10 toward the narrowing portions 4,5 of the envelope.

The lamp of the present invention is manufactured according to a method, wherein the envelope 1 with the two envelope necks 2,3 or the envelope neck projections, respectively, and with the narrowing portions 4,5 integrally formed in each transition from envelope to envelope neck is manufactured from a quartz tube of predetermined length, the exhaust tube 13 is mounted on one of the envelope necks, the completely mounted stem, i.e., provided with an electrode, a body as supporting part applied concentrically and easily movable on the electrode rod located between the electrode and the seal, a metal spring loosely arranged around the electrode rod between this body and the seal and the electrode rod seal at which the pressed-against seal flare is positioned, is so inserted in the envelope neck that the supporting part 10 with its rounded end rests against the integrally formed narrowing portion 4,5 and on its other side is pressed against the narrowing portion 4,5 by the metal spring 11. After the adjustment of the position of the electrodes, the seal flare is fused upon exposure to inert gas to the envelope with the envelope neck end serving as jacket tube. The lamp is, in the same way, provided with the lamp stem assembly at its other end, is then evacuated through the exhaust tube 13, filled, and then exhaust tube 13 is tipped off.

This fabrication method has the advantage that since the narrowing portions 4,5 are already integrally formed in the envelope, after the sealing no subsequent heat treatment for generating the narrowing portions has to be effected which—because of the difficult forming of the envelope material—can only be carried out by trained specialists. It is also advantageous that when inserting the mounted lamp stem attention must be paid only to the positioning of the electrodes in the envelope, since the supporting part 10 is automatically placed in its proper position. Thus, the manufacture of the lamp is substantially simplified. Further, due to the valve seat of the supporting part 10 at the narrowing portions, all gaps are avoided which otherwise cannot be prevented by virtue of the required production tolerances between the supporting part and the envelope neck. Such gaps, found in the prior art, impair the support effect which may cause breakage during transport.

The supporting part 10 also has a favorable effect on the arc stabilization and the blackening of the lamp. The supporting part 10 separates the large clearance in the envelope neck from the discharge space, and the arc thus burns steadier. Due to the arrangement of the supporting part 10 behind the narrowing portions 4,5 in the envelope neck, the coldest spot of the discharge no longer lies at the envelope, but at the narrowing portions 4,5 so that evaporated electrode material is deposited at this location where it does not obstruct the luminous emittance.

We claim:

1. In an elongated high-pressure electric discharge lamp having a pair of electrode rods having respective electrodes (8,9) at the ends thereof; a quartz glass envelope (1) containing a rare gas and surrounding the discharge space and the electrodes; and a pair of envelope necks (2,3) respectively coupled to opposite ends of said envelope (1) and located in the direction of the longitudinal axis of the lamp, said envelope necks surrounding respective electrode rods and having at their outer ends a vacuum-tight seal to the respective electrode rod;

the improvement comprising the combination of:

a pair of supporting parts (10), each being mounted in a respective envelope neck, each supporting part having a smaller cross section than the envelope neck and being arranged between the respective electrode and electrode seal, said supporting parts each having a substantially central bore through which an electrode rod is passed so as to surround a respective electrode rod;

each envelope neck (2,3) having a pre-formed narrowing (4,5) at the transition thereof to the envelope (1), each narrowing (4,5) having an inclined inner surface at the side thereof facing away from said discharge space in said envelope (1), which inclined surface forms a valve-seat-like bearing surface for said supporting part (10);

each supporting part (10) having a rounded end facing said discharge space and resting against a respective inclined surface, such that said supporting parts automatically position themselves against said respective inclined surface and thereby automatically position said electrode rods and electrodes (8,9) relative to the longitudinal axis of the lamp; and means for securing each supporting part in the direction of the longitudinal axis of the lamp, with said supporting parts located between said discharge space and a respective electrode seal and urging the supporting parts (10) against a respective inclined surface of a respective narrowing.

2. The high-pressure electric discharge lamp of claim 1, wherein said supporting parts each have a smaller diameter at the end thereof turned away from said discharge space than at the end thereof facing said discharge space, the end facing said discharge space having a diameter substantially similar to the inner diameter of said envelope neck in the area said supporting parts contact the respective envelope necks.

3. The high-pressure electric discharge lamp of claim 1, wherein said supporting part comprises a cylindrical ring.

4. The high-pressure electric discharge lamp of any one of claims 1 to 3, wherein each supporting part in addition to said substantially central bore has further perforations therein.

5. The high-pressure electric discharge lamp of any one of claims 1 to 3, wherein said supporting parts have indentations at their outer periphery.

6. The high pressure electric discharge lamp of claim 5, wherein said indentations are at the outer periphery of the portion thereof having the largest diameter.

7. The high-pressure electric discharge lamp of any one of claims 1 to 3, wherein said supporting part is made of quartz glass.

8. The high-pressure electric discharge lamp of any one of claims 1 to 3, wherein said securing means comprises means for resiliently pressing said support parts against a respective inclined surface.

9. The high-pressure electric discharge lamp of claim 8, wherein said securing means comprising a spring wire coiled around each electrode rod for pressing against a respective supporting part.

10. The high-pressure electric discharge lamp of any one of claims 1 to 3, wherein said securing means comprises a spring wire coiled around each electrode rod for pressing against a respective supporting part.

11. A method of manufacturing the high-pressure electric discharge lamp as claimed in claim 1, comprising:

integrally forming said envelope (1) with said two oppositely extending envelope necks (2,3), and said narrowings at each transition from envelope to envelope neck from a quartz tube of predetermined length;

mounting an exhaust tube on one of said envelope necks;

mounting a completely assembled stem assembly to each envelope neck, each stem assembly including an electrode at the end of an electrode rod, a supporting part mounted concentrically and easily movable on said electrode rod so as to be located between the electrode and the seal of the envelope neck, a metal spring loosely attached around said electrode rod between said supporting part and said seal, said stem assembly being mounted by inserting same into the prespective envelope neck such that the supporting part with its rounded end rests against the integrally formed narrowing and on its outer side is pressed against the respective narrowing by the metal spring;

after the adjustment of the position of the electrodes, fusing a seal flare upon exposure to inert gas with the envelope neck end serving as a jacket tube; and after mounting and sealing the ends of both envelope necks, evacuating said lamp through the exhaust tube, filling same and then tipping off the exhaust tube.

12. The high-pressure electric discharge lamp of claim 1, wherein said supporting parts (10) act as heat sink means adjacent said narrowing portions (4,5) for causing evaporated electrode material to be preferentially deposited on said narrowing portions (4,5) rather than on a light emitting portion of said envelope (1), thereby avoiding obstruction of luminous emittance from said discharge.

* * * * *

UNITED STATES PATENT AND TRADEMARK OFFICE

CERTIFICATE OF CORRECTION

PATENT NO. : 4,463,281

DATED : July 31, 1984

INVENTOR(S) : Walter TRIEBEL et al

It is certified that error appears in the above-identified patent and that said Letters Patent is hereby corrected as shown below:

Column 6, line 10 (claim 11), change "prespective" to --respective--.

Signed and Sealed this

*Nineteenth* Day of *March 1985*

[SEAL]

*Attest:*

DONALD J. QUIGG

*Attesting Officer* *Acting Commissioner of Patents and Trademarks*